United States Patent [19]

Hesch

[11] 4,098,022

[45] Jul. 4, 1978

[54] PLUG SLIDING DOOR

[75] Inventor: Harold E. Hesch, St. John, Ind.

[73] Assignee: Pullman Incorporated, Chicago, Ill.

[21] Appl. No.: 760,049

[22] Filed: Jan. 17, 1977

[51] Int. Cl.[2] ..... E05D 15/10

[52] U.S. Cl. ..... 49/209; 49/218; 49/426; 49/472

[58] Field of Search ..... 49/209, 408, 220, 426, 49/219, 427, 218, 410, 215, 411, 472, 474, 473; 52/625

[56] References Cited

U.S. PATENT DOCUMENTS

| | | | |
|---|---|---|---|
| Re. 28,443 | 6/1975 | Ross, Jr. et al. | 49/220 |
| 1,605,301 | 11/1926 | Tobin et al. | 49/474 |
| 1,658,978 | 2/1928 | Fehr et al. | 52/625 X |
| 1,745,846 | 2/1930 | Eklind et al. | 52/625 |
| 2,902,122 | 9/1959 | Beauchamp | 49/426 |
| 2,974,376 | 3/1961 | Shaver et al. | 49/408 X |
| 3,768,422 | 10/1973 | Shaver et al. | 49/408 X |

*Primary Examiner*—Philip C. Kannan
*Attorney, Agent, or Firm*—Thomas G. Anderson

[57] ABSTRACT

A plug type of railway car door includes vertical edge beams of tubular construction connected by corrugated panel means. The beams are of a construction reacting with the door parts to effectively center the door within its opening and seal the same.

8 Claims, 3 Drawing Figures

PLUG SLIDING DOOR

BACKGROUND OF THE INVENTION

1. Field of the Invention

The present invention pertains to railway freight cars and in particular to a freight car door construction.

2. Description of the Prior Art

The prior art door constructions are exemplified by U.S. Pat. Nos. Re. 28,443; 3,039,154 and 3,786,599. None, however, disclose the novel door centering and labyrinth car door sealing construction embodied in the present invention as hereinafter described.

SUMMARY OF THE INVENTION

The present invention relates to a railway freight car door construction and particularly to the door centering and sealing structure. The door includes a corrugated panel portion and fore and aft edge beams which are seatably engageable between and about the door posts of the car to seal off the door opening when the door is moved to its closed position. The invention further provides that the edge beams be of a hollow construction generally pentagonal in horizontal cross-section and including resilient flange portions such that each beam is reactive with its associated door post and associated structure to center and cushionably emplace the door in the door opening as it is sealably seated therein.

DESCRIPTION OF THE PREFERRED EMBODIMENT

Figure 1:
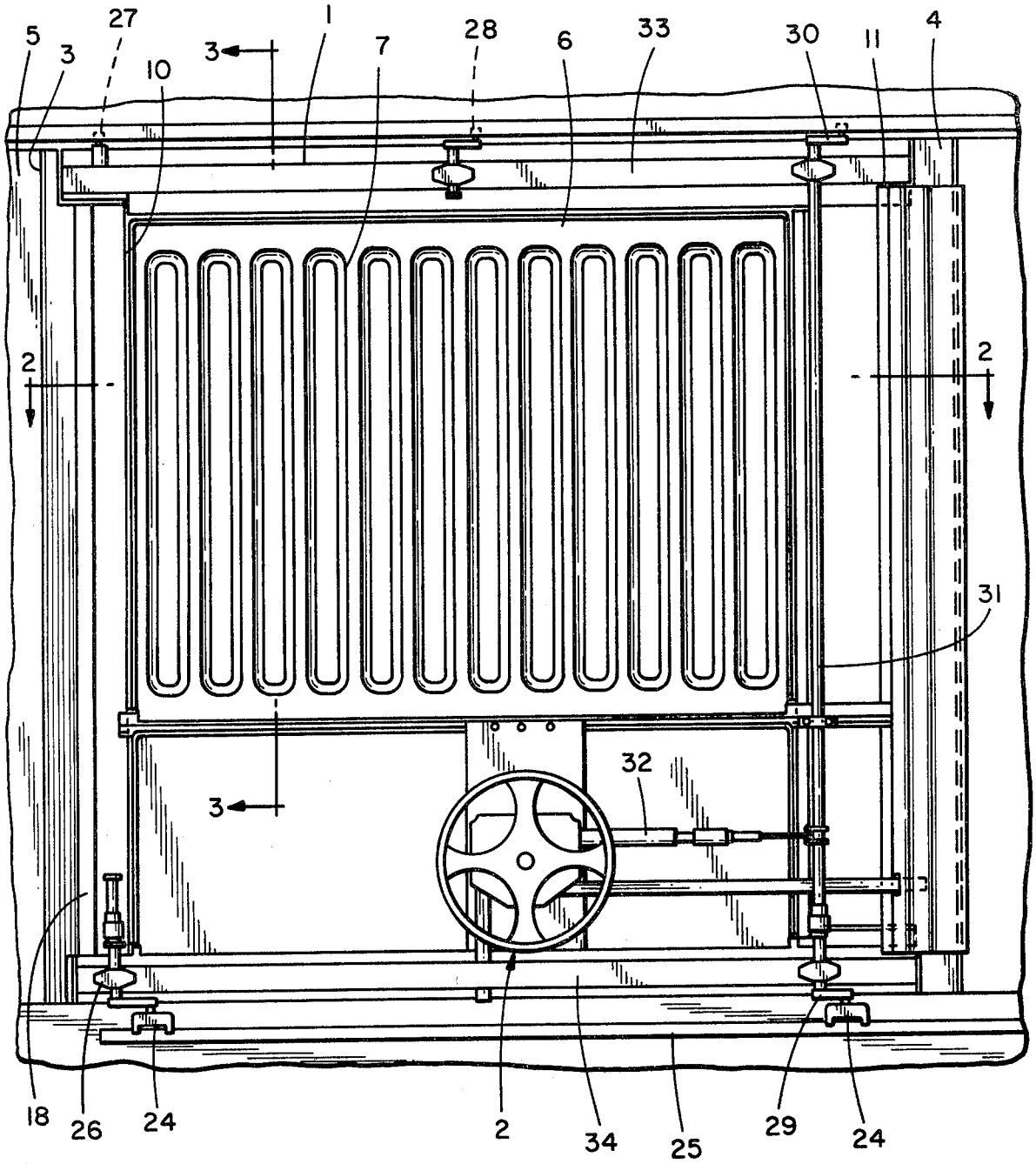
FIG. 1 shows a side elevational view of a portion of a railway box car incorporating the door construction of the present invention.
Figure 2:
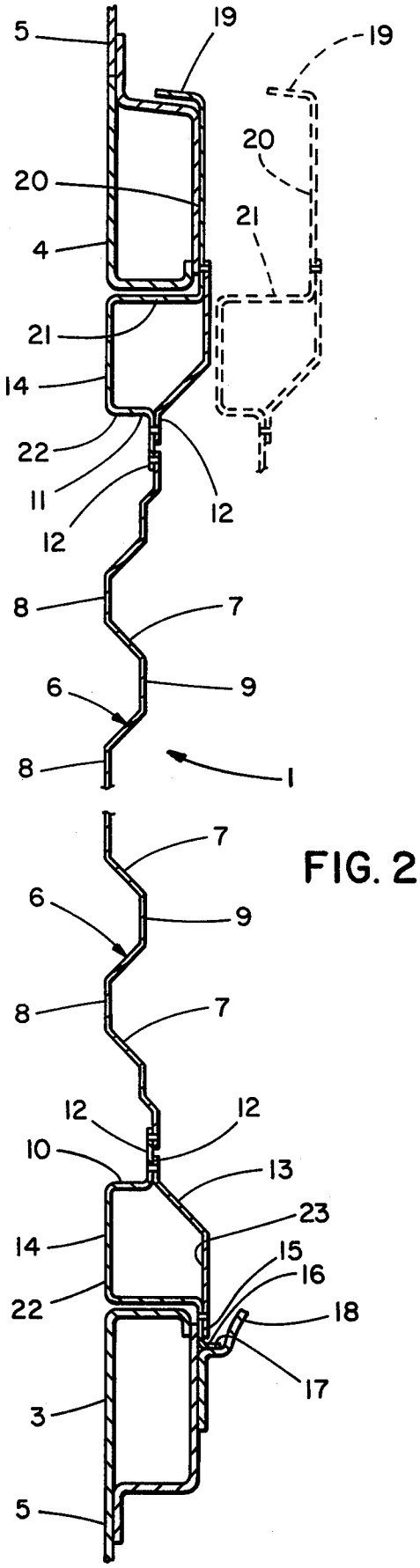
FIG. 2 shows a horizontal cross-section of the door taken along line 2—2 of FIG. 1 and rotated counterclockwise 90°.
Figure 3:
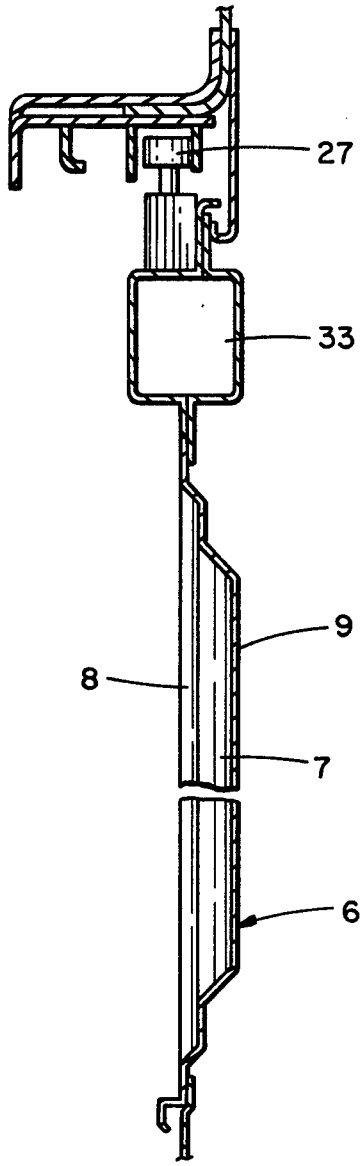
FIG. 3 shows an elevational cross-section of the door taken along line 3—3 of FIG. 1.

The present invention is particularly concerned with providing a weather seal for a sliding plug door in a railway box car which is not susceptible to deterioration such as rubber gaskets or the like during the 30–40 year service life of the car. As shown in FIG. 1, the invention is embodied in a sliding plug door 1 and operating mechanism 2 which may be of conventional construction as disclosed in the Prior Art. A door opening is defined by laterally spaced door posts 3 and 4 provided in a side wall 5 of a railway box car. The door 1, for closing said door opening includes an intermediate panel portion 6 having vertically extending corrugations 7 including inner and outer wall sections 8 and 9, respectively. The edges of the panel portion 6 are connected to flanges 12 by rivets as indicated. The beams 10 and 11 are of a hollow construction and generally pentagonal horizontal cross-section and include outwardly sloping portions 13 and inner wall portions 14 and outer wall portions 23. As can be seen from FIG. 2, in the closed position of the door, the inner wall section 8 and the inner wall portion 14 are laterally aligned with the inner surface of the car wall to form a relatively smooth surface in the interior of the car.

The forward edge of the beam 10 is provided with a longitudinal tongue or protruding flange 15 extending substantially the height of the door and having an outwardly extending end portion 16 which is abutting engageable within a vertical recess 17 formed between the outboard surface of the post 3 and an outwardly curving resilient vertical vane 18 cantilevered from the post 3.

The beam 11 of the door includes a rearwardly extending flange 19 generally L-shaped in cross-section and vertically coextensive with the door. As can be seen from FIG. 2, when the door is in the closed weather sealing position the vertical channel 20 formed by the flange 19 and edge 21 of the beam 14 envelops the door post 4. Thus, it can be seen that when the door is moved to its closed position, the door posts 3 and 4 and beams 10 and 11 of the door cooperate to form a structural labyrinth which seals the interior of the car against the elements and foreign matter.

The geometry of the intermediate panel 6 and the beams 10 and 11 further contribute to the weather sealing feature of the invention. More particularly, when a box car is being moved in open country at high speeds which may be in excess of 80 mph, it is particularly susceptible to forced seepage of water or the elements about the edges of the door. One reason for this is that a layer of water tends to adhere and flow on the surface of the door. However, the thickness of the layer and therefore the quantity of water which will flow on the surface of the door is largely dependent on the direction and turbulence of the air flow immediately adjacent the car. Thus, by providing an outer door structure which assures turbulent air flow adjacent the car and which directs air flow outwardly therefrom (e.g., the vertical corrugations in the door panel portion 6, the outwardly curving vane 18, and the outwardly sloping edge beam portions 13) the present invention promotes separation of the water layer from the car door and thereby further assures the integrity of the labyrinth door seal disclosed herein.

As noted above, the hollow pentagonal cross section configuration of the beams 10 and 11 accommodates slight twisting or deflection. i.e., the inner rectangular portions 22 will tend to yield or twist more so than the relatively rigid triangular outer portions 23 so that if the door is longitudinally misaligned due to wear, when the door is moved inwardly toward the closed position, the inner portions 22 will wedgingly engage the door posts 3 and 4 and tend to react thereagainst to center or urge the door into proper alignment. Similarly, if the door moves too far forward during the closing operation, the cooperative springing actions of the vane 18 and tongue 15 will tend to urge the door rearwardly and inwardly into its closed position.

The door 1 is of the plug sliding type with the operating mechanism 2 including a hand wheel 36. Roller assemblies 24 support the door 1 on a track 25 supported below the door opening on the car. A pivot pedestal 26 connected to the door is supported on one of the roller assemblies 24. The door is guided at its upper end by upper roller supports 27 and 28 supported on the car structure. Lower and upper crank arms 29 and 30 are connected to a pipe 31 which moves the door outwardly by means of linkage 32 actuated by the hand wheel 36. The hand wheel 36 also operates a locking bolt. The door 1 also includes upper and lower hollow beams 33 and 34 suitably connected to the beams 10 and 11.

The novel door sealing and centering construction set out in the foregoing description and drawings merely explains and illustrates the invention and the invention is not limited thereto, except insofar as the appended claims are so limited, as those skilled in the art who have the disclosure before them will be able to make modifications and variations therein without departing from the scope of the invention.

What is claimed is:

1. In a railway car having a side wall including horizontally spaced vertical door posts providing a door opening, a door assembly adapted to be moved outwardly and laterally with respect to said opening comprising;

first and second horizontally spaced vertical edge beams, a door panel connecting said beams, said beams each including a vertical inner wall and a vertical outer wall, said outer wall having a vertical wall portion sloping inwardly and including flanges connected to said door panel, vertical side walls on each said beam connecting said inner and outer walls providing a tubular configuration, and resilient flange means on said outer walls of each beam overlapping portions of said door posts in the closed position of said door assembly, one of said resilient flange means including a resilient flange member having a vertical wall projecting laterally outwardly from said outer wall and extending over one of said door posts, said resilient flange member including a flange portion projecting inwardly of and in transverse relation to said outer wall of said door post, the other of said resilient flange means including an angle-shaped vertical sealing member having an overlapping sealing relationship with the outer wall of the other door post.

2. The invention in accordance with claim 1, said door posts having a rectangular tubular configuration including vertical inner and outer walls parallel to said inner and outer walls of said beam, and said resilient flange member overlapping the outer wall of said door parts.

3. The invention in accordance with claim 1, said door panel portion including vertical corrugations having inner and outer relatively parallel vertical plate portions.

4. The invention in accordance with claim 3 said flanges of said beams and said plate portions being relatively parallel.

5. The invention in accordance with claim 3, said outer parallel vertical plate portion being disposed laterally inwardly of said outer walls of said beam.

6. The invention in accordance with claim 1, said other door post including a vertically extending relative resilient vane type member projecting outwardly from said post and inwardly toward said door opening.

7. The invention in accordance with claim 6, said vane type member and said other door post providing a vertical recess receiving said sealing member in the closed position of said door.

8. In a railway car having a side wall including horizontally spaced vertical door posts providing a door opening, a door assembly adapted to be moved outwardly and laterally with respect to said opening comprising;

first and second horizontally spaced vertical edge beams, a door panel connecting said beams, said beams each including a vertical inner wall and a vertical outer wall, said outer wall having a vertical wall portion sloping inwardly and including flanges connected to said door panel, vertical side walls on each said beam connecting said inner and outer walls providing a tubular configuration, and resilient flange means on said outer walls of each beam overlapping portions of said door posts in the closed position of said door assembly, and said resilient flange means at one edge of the door including a wall portion overlapping the outer side of the associated door post and having a wall portion covering another wall portion of the post and extending therewith transversely of the side wall of the car.

* * * * *